US005543235A

United States Patent [19]

Mirchandani et al.

[11] Patent Number: 5,543,235

[45] Date of Patent: Aug. 6, 1996

[54] MULTIPLE GRADE CEMENTED CARBIDE ARTICLES AND A METHOD OF MAKING THE SAME

[75] Inventors: Prakash K. Mirchandani, Allison Park; Robert E. Thomas, Beaver Falls; Mark Cippel, Ford City, all of Pa.

[73] Assignee: SinterMet, Kittanning, Pa.

[21] Appl. No.: 233,388

[22] Filed: Apr. 26, 1994

[51] Int. Cl.[6] ..... B22F 3/12; B22F 7/06

[52] U.S. Cl. ..... 428/547; 428/551; 428/552; 428/553; 428/558; 419/5; 419/10; 419/14; 419/38

[58] Field of Search ..... 419/5, 10, 14, 419/38; 428/547, 551, 552, 553, 558

[56] References Cited

U.S. PATENT DOCUMENTS

| | | | |
|---|---|---|---|
| Re. 34,180 | 2/1993 | Nemeth | 428/547 |
| 4,610,931 | 9/1986 | Nemeth et al. | 428/547 |
| 4,812,370 | 3/1989 | Okada et al. | 428/552 |
| 4,911,625 | 3/1990 | Begg et al. | 419/6 |
| 4,990,410 | 2/1991 | Saitoh et al. | 428/547 |
| 5,041,261 | 8/1991 | Buljan et al. | 419/11 |
| 5,110,687 | 5/1992 | Abe et al. | 428/551 |
| 5,223,020 | 6/1993 | Kolaska | 75/238 |
| 5,240,672 | 8/1993 | Yang | 419/47 |
| 5,266,415 | 11/1993 | Newkirk et al. | 428/545 |
| 5,330,553 | 7/1994 | Weinl et al. | 75/236 |
| 5,376,329 | 12/1994 | Morgan et al. | 419/39 |

OTHER PUBLICATIONS

"Rock Tools leads the way in drilling," MPR Dec. 1992, pp. 48–50.

*Primary Examiner*—Charles T. Jordan
*Assistant Examiner*—Chrisman D. Carroll
*Attorney, Agent, or Firm*—Reed Smith Shaw & McClay

[57] ABSTRACT

The present invention provides multiple grade, composite cemented carbide articles and a method of making such articles. The cemented carbide articles comprise carbides of different grades (or different compositions and/or microstructures) and, therefore, correspondingly different properties at different locations in the same article. The method of the present invention comprises filling different areas or portions of a die with metallurgical powders having different compositions and/or microstructures. The powder is then compressed as a single compact in the die cavity. The compressed compact is subsequently sintered to produce a multigrade cemented carbide article having composition and/or microstructural variations within the volume of the article.

6 Claims, 5 Drawing Sheets

MULTIPLE GRADE CEMENTED CARBIDE ARTICLES AND A METHOD OF MAKING THE SAME

FIELD OF THE INVENTION

The present invention relates to cemented carbide articles and especially to multiple grade, composite cemented carbide articles and a method of making such multiple grade, composite cemented carbide articles.

BACKGROUND OF THE INVENTION

Cemented carbides are technologically important materials which offer unique combinations of properties such as strength, hardness, toughness, and wear resistance. They are extensively employed in metal forming tools and metal cutting tools. For example, important industrial applications of cemented carbides include rings for rolling metals as well as knives for slitting and side trimming of sheet and strip metals.

In general, cemented carbides comprise one or more "hard" phases (usually carbides of the elements belonging to groups IVB through VIB of the periodic table, e.g., W, Ti, Ta, Nb, Cr, V, Mo, Hf and Zr) cemented or bound together by a softer binder phase (usually metals belonging to the Fe-group, i.e., Co, Ni, or Fe, or alloys of these metals). Cemented carbides are prepared using powder metallurgy techniques. The principal steps in such a fabrication process include preparing an intimate blend of carbide and binder metal particles, compressing the blended particles (powder) to the desired shape in a rigid or flexible die, and liquid-phase sintering of the resultant powder compact to achieve the fully dense cemented carbide article. The composition and fabrication of cemented carbide articles are discussed in detail in Schwarzkopf, P. and Kieffer, R., *Cemented Carbides*, The MacMillan Company, New York (196), the disclosure of which is incorporated herein by reference.

The properties of cemented carbides are determined by the overall composition, including the identity of the carbide, the identity of the binder and the fraction of binder present (i.e., the ratio of binder to carbide), and the average grain size of the hard phase. A metallurgist may vary one or more of these parameters to design cemented carbides for different applications.

In the general case, as grain size increases (i.e., increasing coarseness) the hardness of the article decreases and the toughness increases. Increasing the binder fraction has an effect similar to increasing grain size (i.e., the hardness decreases and the toughness increases). The properties of a cemented carbide article are thus optimized by appropriately selecting the overall composition and grain size. The effect of the composition and grain size upon the properties of cemented carbides is discussed in detail in Schwarzkopf et al., supra.

Because of inherent limitations of the conventional powder metallurgy process described above, cemented carbide articles are invariably fabricated having a substantially uniform composition and microstructure (on a scale of millimeters or centimeters), and hence, substantially uniform properties, throughout the volume of the article. Many such substantially homogeneous compositions exist in the prior art.

However, it is desirable in a number of applications to fabricate cemented carbide articles having nonuniform properties. In that regard, the spatial composition of cemented carbide articles has, in the past, been altered in a very limited sense by varying the distribution of the concentration of the single metallic carbides throughout the article.

Recently, for example, a process for producing cemented carbides comprising a single carbide but having different compositions and/or microstructures at different locations within an article has been described in a report by Sandvik Hardmetals in *Metals Powder Report* (December 1992). The Sandvik technique (known as Dual-Phase or DP Technology) consists of carburizing cemented carbide articles which initially have lower than normal levels of carbon. During the carburizing process, a compositional gradient is created within the article, resulting in slightly different property levels at different locations within the article.

The Sandvik method is severely limited, however, in that it does not enable fabrication of materials with substantially different compositional variations. For example, combining a Co-based cemented carbide with a Ni-based cemented carbide or even having a single-element carbide in which the composition (carbide/binder ratio) varies widely is not possible under the Sandvik process. Furthermore, it is virtually impossible using the Sandvik process to fabricate articles with substantially different grain sizes in different regions within an article.

Nevertheless, in many applications it is desirable to have substantially different properties and/or compositions at different locations in the cemented carbide article. For example, it may be desirable to have high wear resistance near the surface of an article but a high level of toughness in the interior of the article. However, toughness invariably decreases if the material is designed to have high hardness and wear resistance. Such a "dual-property" material is impossible to fabricate in cemented carbide articles using conventional powder metallurgy techniques (as such articles invariably have a substantially homogeneous composition and microstructure throughout the volume of the article).

Furthermore, it may be desirable for the working volume of a cemented carbide article to comprise a high-grade (and expensive) cemented carbide with a certain level of properties while the remaining portion of the article comprises a less expensive, lower grade of material. This result is likewise impossible to achieve under conventional powder metallurgy processes.

It is, therefore, desirable to develop a method of producing novel cemented carbide articles comprising multiple grades of cemented carbides. Each portion of such cemented carbide articles could be manufactured to exhibit different properties by virtue of its distinct composition and/or microstructure (i.e., its distinct grade).

SUMMARY OF THE INVENTION

Accordingly, the present invention provides a method for producing multigrade cemented carbide articles. Generally, the method comprises filling a first portion of a die with a first metallurgical powder. The first metallurgical powder comprises a blend of a carbide(s) of one or more elements selected from groups IVB through VIB of the periodic table and a binder comprising a metal selected from the group consisting of Co, Ni and Fe (or an alloy thereof). A second portion of the die is filled with a second metallurgical powder of a different grade (i.e., different composition and/or microstructure) from the first metallurgical powder. The second metallurgical powder also, however, comprises a blend of a carbide(s) of one or more elements selected from groups IVB through VIB of the periodic table and a binder comprising a metal selected from the group consisting of Co, Ni and Fe (or an alloy thereof).

The first metallurgical powder and the second metallurgical powder are then compressed as a single compact to a desired shape. The compacted shape is then sintered at an appropriate temperature to produce a multigrade cemented carbide article of the desired shape. The multigrade cemented carbide article thus comprises a first cemented carbide portion, corresponding to the first portion of the die, and a second cemented carbide portion of a different grade from the first cemented carbide portion, corresponding to the second portion of the die.

A die of multiple portions may be produced by partitioning the die into at least a first portion and a second portion, using a removable partition means such as a metal sleeve. Before compression, the partition means is removed so that the first metallurgical powder and the second metallurgical powder come into contact with each other.

The present invention also provides multigrade cemented carbide articles comprising a first portion comprising a first cemented carbide of a first grade. The first grade is defined by the composition and the microstructure of the first cemented carbide. The first cemented carbide is preferably substantially homogeneous with respect to the first grade throughout the first portion. This substantial homogeneity is on the scale of millimeters or centimeters. All cemented carbides are by their very nature heterogeneous on the scale of microns.

The multigrade cemented carbide articles further comprise at least a second portion comprising a second cemented carbide of a second grade. The second grade is different from the first grade in that at least one of the second composition and the second microstructure is different from the first composition and the first microstructure. Like the first cemented carbide, however, the second cemented carbide is preferably substantially homogeneous with respect to the second grade throughout the second portion. The first cemented carbide and the second cemented carbide are metallurgically fused via sintering to form the multigrade cemented carbide article.

Metallurgical powders of various composition and grain size are commercially available from numerous suppliers listed, for example, in *World Directory and Handbook of Hardmetals and Hard Materials*, by Kenneth J. A. Brookes, International Carbide Data, Hertfordshire, United Kingdom. Each particle of these powders comprises a composite blend of a binder and polycrystalline carbide prepared by a spray drying technique. The overall composition and grain size of the cemented carbide powder is controlled by the supplier at the time of manufacture using techniques well known in the art. Thus, a metallurgical powder of a particular composition and average grain size for use in the present invention may be readily obtained from a number of suppliers upon request.

The method and article of the present invention are completely different from the methods employed in the prior art and the articles produced therefrom. Indeed, the method of the present invention is considerably more versatile than such earlier techniques. In the present invention the compositional and/or microstructural variations within an article are created at the powder pressing stage.

Major advantages of producing the present multigrade cemented carbide articles include the ability to tailor the properties of cemented carbide articles to suit a wider variety of applications, and the ability to reduce the cost of manufacture of cemented carbide articles.

BRIEF DESCRIPTION OF THE DRAWINGS

FIG. 1(*b*) illustrates a multiple grade cemented carbide rolling ring.

FIG. 3(*b*) illustrates the microstructure of a multiple grade cemented carbide slitting/trimming knife.

FIG. 4(*b*) illustrates a multiple grade, layered cemented carbide article.

PRESENTLY PREFERRED EMBODIMENT

For the purpose of the present invention a cemented carbide material preferably comprises approximately 60 to 98% by weight of one or more of the carbides of the elements belonging to groups IVB through VIB of the periodic table (e.g., W, Ti, Ta, Cr, V, Mo, Nb, Hf and Zr) and approximately 2 to 40% by weight of a binder alloy. The average grain size of the cemented carbides preferably varies within the range of approximately 0.5 to 10.0 μm.

The binder preferably comprises Co, Ni, or Fe, or mixtures (alloys) of these elements in any proportion. The binder phase may also contain elements such as W, Cr, Ti, Ta, V, Nb, C, etc. up to the solubility limits of these elements in the binder alloy. Additionally, the binder may contain up to 5% by weight of elements such as Cu, Mn, Ag, Al, etc. One skilled in the art will recognize that any or all of the constituents of the cemented carbide material may be introduced in elemental form, as compounds, and/or as master-alloys.

Generally, there is no restriction, compositionally or microstructurally (i.e., carbide grain size), to the grades of cemented carbide that may be combined to produce a dual- or other multiple grade ("multigrade") component or article. In general, the "grade" of the cemented carbide is defined by its composition (i.e., the identity of its constituents and the amounts thereof) as well as its microstructure (grain size). Two cemented carbides of different grades have different compositions and/or microstructures and, therefore, have different properties.

EXAMPLE 1

Figure 1A:
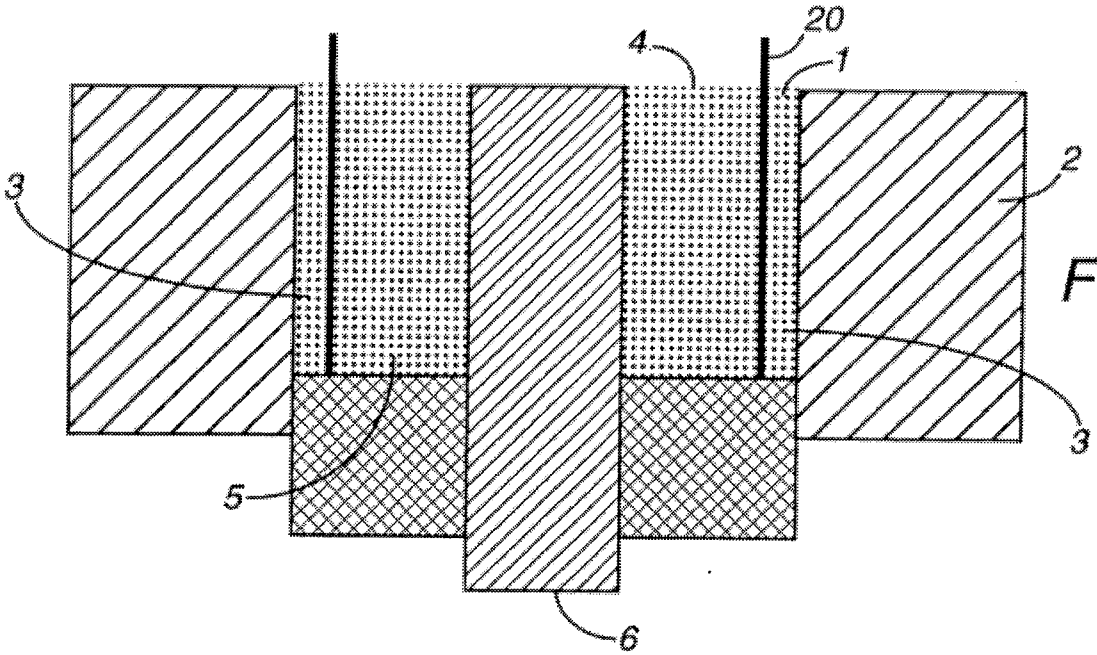
FIG. 1(*a*) illustrates the fabrication of a multiple grade cemented carbide rolling ring.
Figure 1B:
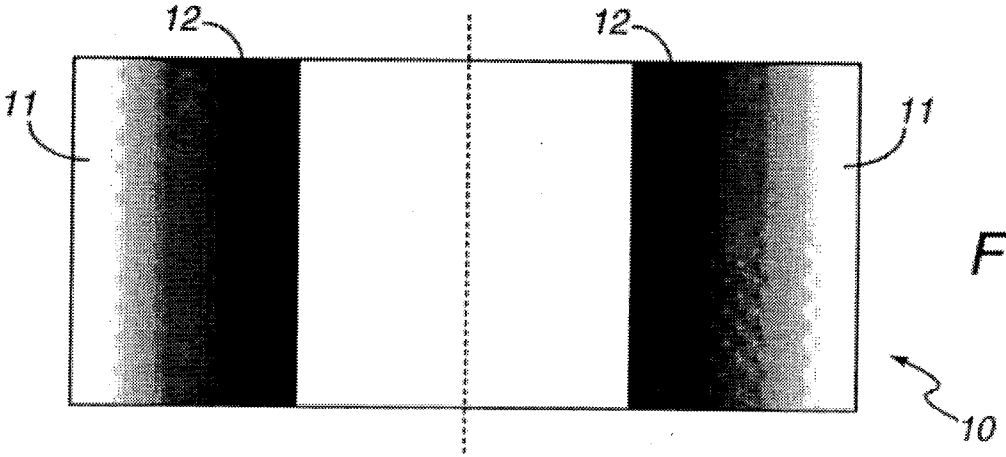

Referring to FIG. 1(*a*), the general method of producing multiple grade, composite cemented carbide articles can be described. In one application, the outer portion 1 of die 2 is filled with a Co—WC powder 3 while the inner portion 4 is filled with a Ni—WC powder 5. Partition means 20 is then withdrawn. Core rod 6 of die 2 results in an annular ring shape to form, for example, a metal rolling ring 10 shown in FIG. 1(*b*).

The composite powder volume is compressed to the desired thickness/density. Compression is achieved by compressively driving a lower punch 7 and an upper punch (not shown). Pressures of 2–20 tons/in$^2$ (at room temperature) can be used to achieve compression. After compression, the compressed article is sintered as a single component (as would occur for a single-grade component under conventional powder metallurgical techniques).

Specifically, rolling ring 10 was produced as follows:

1. A die set 2 was selected to produce ring 10 with the following approximate finished dimensions: 9" outer diameter×5" inner diameter×1.5" thickness.
2. Cylindrically shaped partition means 20 was fabricated from 1/16" thick mild steel sheet. The outer diameter of partition means 20 was such that it divided the annular cavity of die 2 into two approximately equal sized portions 1 and 4.
1. Partition means 20 was centered in the die cavity. The outer cavity or portion 1 was filled with approximately 8.4 Kg of 20Co—WC powder 3 (i.e., comprising 20 wt % Co and 80 wt % WC), and inner cavity or portion 4 was filled with approximately 5.9 Kg of 30Ni—WC powder 5. The amount of material required was simply calculated from the density of the carbide and the volume desired.
4. Partition means 20 was removed and the powder was compressed as a single compact to the desired thickness of 1.5" in a 750 ton hydraulic press.
5. The resultant unitary powder compact was sintered in a vacuum furnace at 1365° C. for 60 minutes.

One skilled in the art will appreciate that, in practice, the above processing parameters can be varied over a broad range without falling outside the principles of the present invention.

FIG. 1(*b*) illustrates resultant dual-grade cemented carbide rolling ring 10. The outer portion 11 of ring 10 comprises a 20Co—WC alloy while inner portion 12 comprises a 30Ni—WC alloy. The hardness of the outer portion of the ring 10 is 84.5 Rockwell A, while the hardness of the inner portion is 76.5 Rockwell A.

Figure 2:
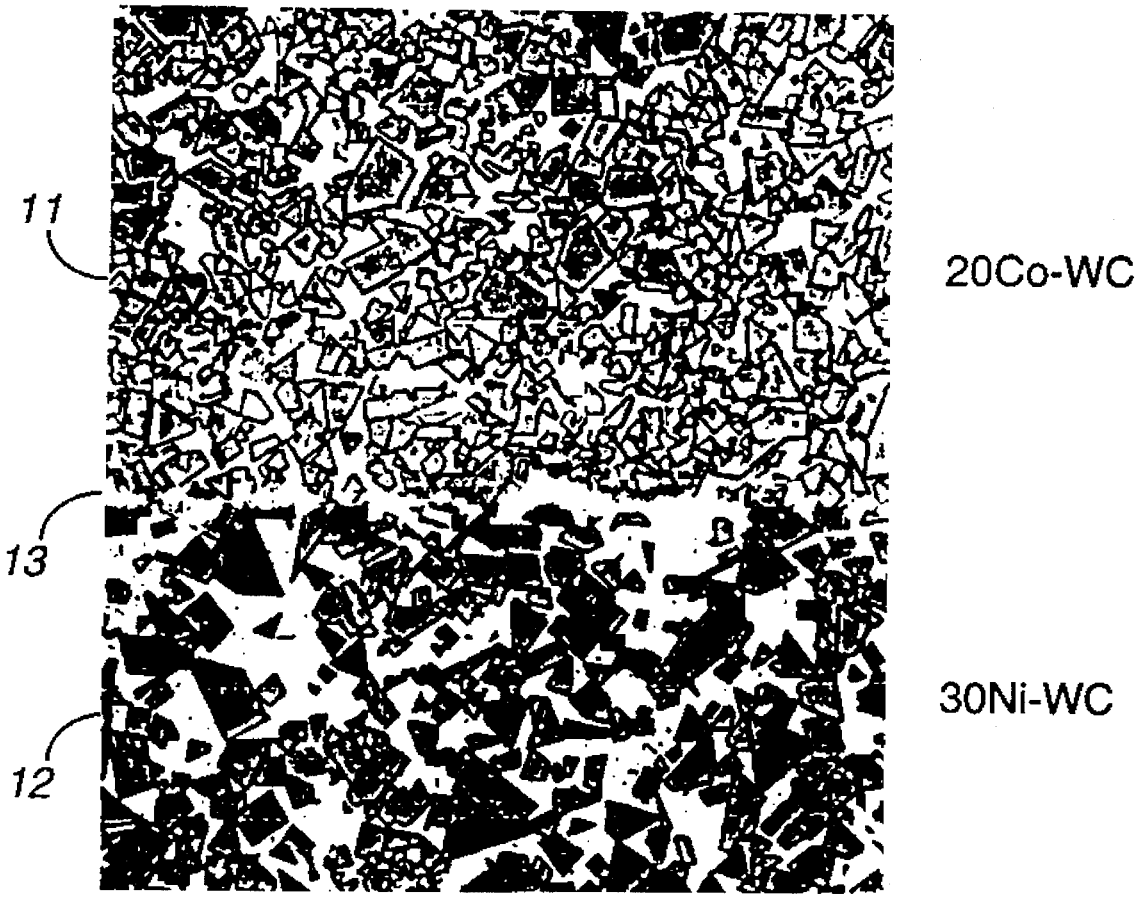
FIG. 2 illustrates the microstructure of a multiple grade cemented carbide rolling ring.

The microstructure of dual-grade rolling ring 10 is shown in FIG. 2. The grade of each portion of 11 and 12 is preferably substantially homogeneous throughout each respective portion, but, as described above, the grade of portion 11 is preferably substantially different from that of portion 12.

There exists between portion 11 and 12 a transitional or interface zone 13 of probably intermediate grade. Transitional zone 13, is very narrow in width compared to the width of roll 10, yet relatively broad when compared to the average grain size of the cemented carbides. It has been found that the metallurgical bonding in the transitional zone is very good and that the strength of the transitional zone is substantially identical to the remainder of the article.

A rolling ring fabricated in the above manner offers many advantages over a ring made entirely with a 20Co—WC cemented carbide. For example, because the 30Ni—WC alloy is significantly less expensive compared to the 20Co—WC alloy, the cost of fabricating a ring made in this manner is considerably lower than a similarly sized ring fabricated entirely from 20Co—WC. However, because the working volume of the dual-grade ring is made entirely from 20Co—WC, there is no loss in performance compared to a solid 20Co—WC ring.

Another advantage of such a rolling ring arises from the various degrees of hardness attainable within the same ring. Since the hardness of inner portion 12 of dual-grade ring 10 is much lower than that of outer portion 11, it is possible to machine a keyway in the bore of the ring. Dual-grade ring 10 can thus be driven by a keyway (not shown) present in the relatively soft, and hence, tough portion 12 of ring 10. Ordinarily, it would not be possible to drive a single-grade 20Co—WC ring with a keyway since the relatively low toughness of the 20Co—WC material would likely result in cracking and premature failure of the rolling ring. The technique of the present invention thus provides a method of extending the applications of cemented carbide materials.

EXAMPLE 2

Figure 3A:
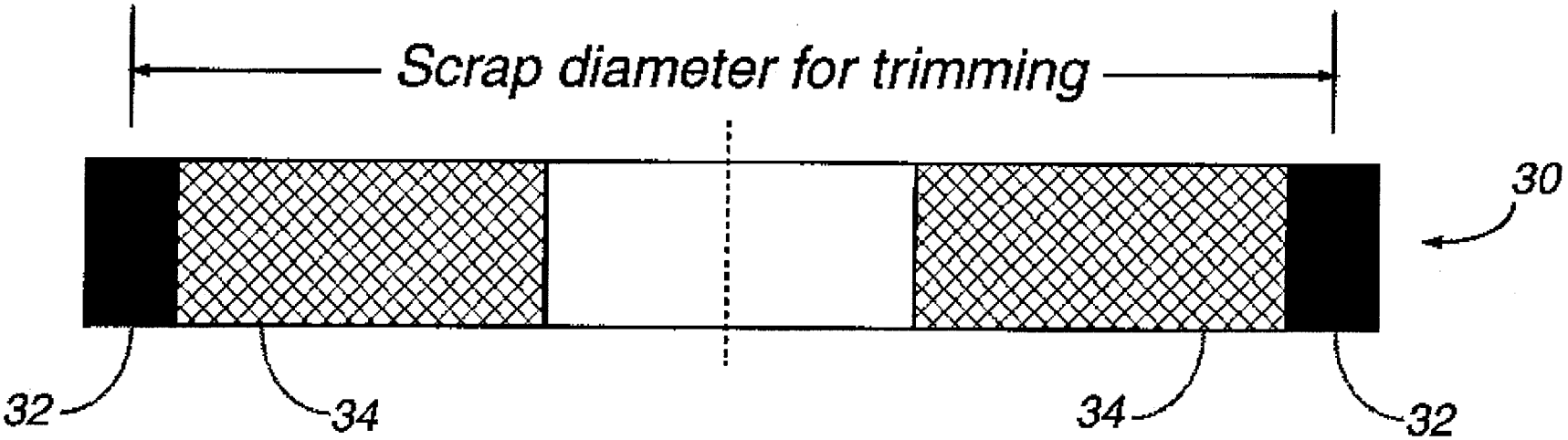
FIG. 3(*a*) illustrates a multiple grade cemented carbide trimming/slitting knife for use in the sheet metal industry.
Figure 3B:
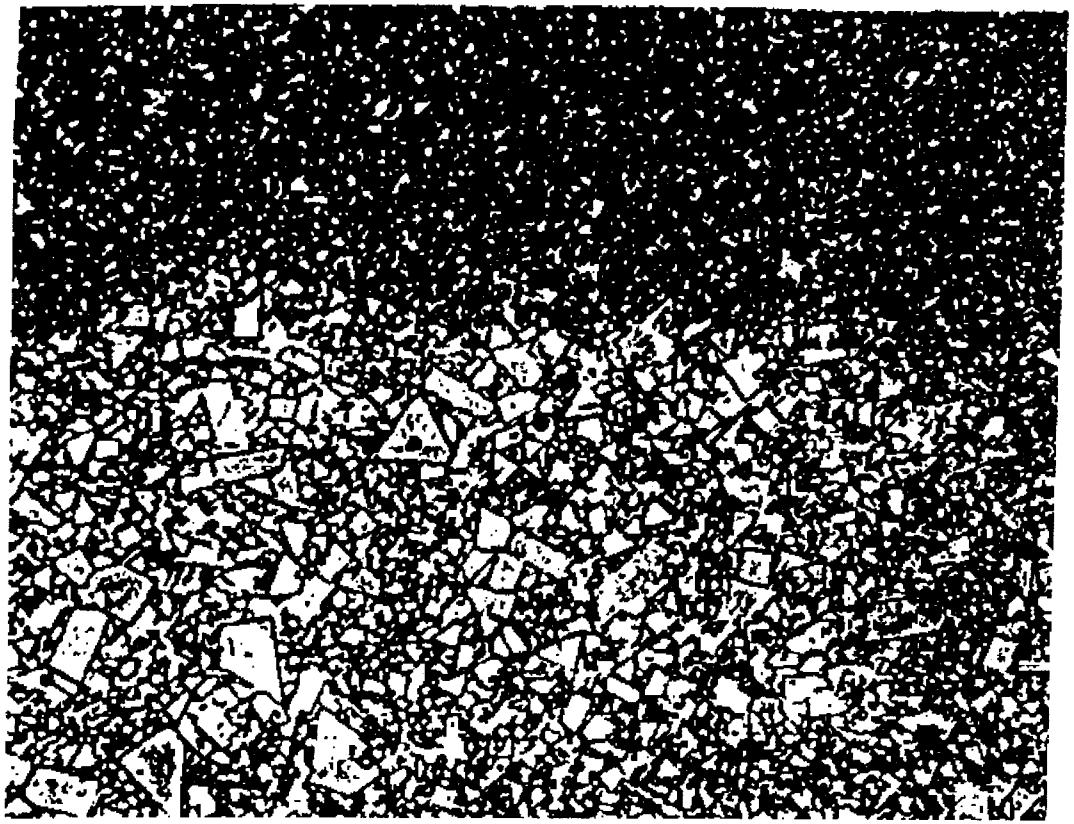

Another example of the extended applicability of the novel multigrade cemented carbides of the present invention is a combination trimmer and slitter knife for use in the sheet metal industry. In general, a relatively coarse-grained and tough cemented carbide is required for trimming, while a fine-grained and hard material is required for slitting. Traditionally, such knives have been fabricated as separate articles resulting in a great deal of material wastage when the knives reach scrap size (i.e., are worn to an unusable size by repeated use). Using the method of the present invention, however, it is possible to fabricate a combination trimmer/slitter knife. FIG. 3(*a*) schematically illustrates such a combination knife 30, while FIG. 3(*b*) illustrates the microstructure of combination knife 30.

In knife 30 a highly wear resistant material (small grain size and low binder content) is encased by a tough material (large grain size and higher binder content). Specifically, a fine-grained (average grain size of approximately 1 μm) 6Co—WC cemented carbide was used for slitting portion 34, while a coarse-grained (average grain size in the range of approximately 4–5 μm) 13Co—WC cemented carbide was used for trimming portion 32.

In use, knife 30 is initially employed for the trimming function. Generally, trimming knives are of larger diameter than slitting knives (e.g., approximately 12 in. and 10 in., respectively). When knife 30 reaches a "scrap" size diameter unsuitable for trimming as depicted in FIG. 3(*a*), the remaining trimming material is ground off and knife 30 can then be employed (utilizing slitting portion 34) for slitting operations. In this manner, knife 30 is reusable, and excess wastage is prevented.

Knife 30 was fabricated using an appropriate die and otherwise under substantially the same technique as described in Example 1. Sintering, however, was carried out at 1400° C. for 60 minutes.

EXAMPLE 3

Figure 4A:
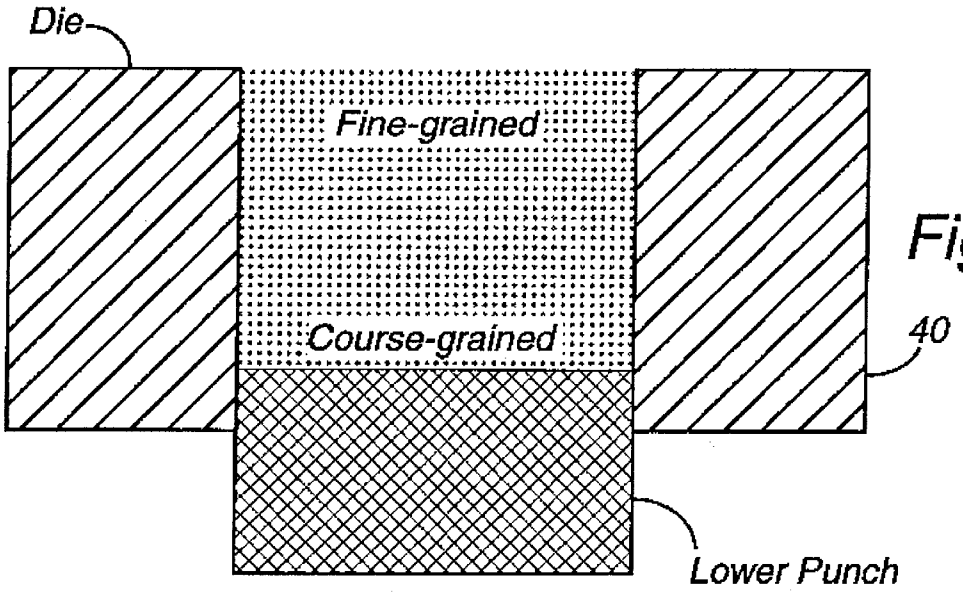
FIG. 4(*a*) illustrates the fabrication of a multiple grade, layered cemented carbide article.
Figure 4B:
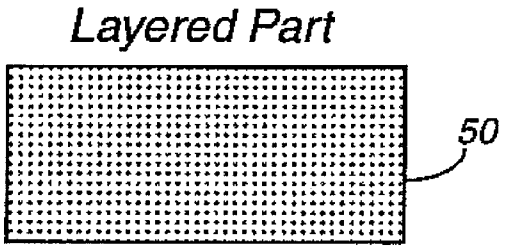

The orientation and number of portions of the multiple grade cemented carbide articles of the present invention are virtually limitless and dictated only by the desired properties of such articles. FIG. 4(*a*), for example, depicts a die 40 for fabricating a horizontally layered multiple grade cemented carbide article 50 (FIG. 4(*b*)). Such an article may be useful, for example, as a wear-resistant seal in chemical processing equipment such as pumps.

Although the invention has been described in detail for the purposes of illustration, it is to be understood that such detail is solely for that purpose and that variations can be made therein by those skilled in the art without departing from the scope of the invention except as it may be limited by the claims.

What is claimed is:

1. A multigrade cemented carbide article produced by the method comprising the steps of:

a. partitioning a die into at least a first portion and a second portion, using a removable partition means;

b. filling the first portion of the die with a first metallurgical powder, the first metallurgical powder comprising a blend of a carbide compound of an element selected from the group consisting of group IVB, group VB and group VIB elements and a binder comprising a metal selected from the group consisting of Co, Ni and Fe;

c. filling the second portion of the die with a second metallurgical powder, the second metallurgical powder comprising a blend of a carbide compound of an element selected from the group consisting of group IVB, group VB and group VIB elements and a binder comprising a metal selected from the group consisting of Co, Ni and Fe; selecting the second metallurgical powder to be of a different grade from the first metallurgical powder in that at least one of a composition of the second metallurgical powder and a grain size of the second metallurgical powder is different from the first metallurgical powder;

d. removing the partition means so that the first metallurgical powder and the second metallurgical powder come into contact with each other;

e. compressing the first metallurgical powder and the second metallurgical powder as a single compact to a desired shape; and f. sintering the resultant single compacted shape at an appropriate temperature to produce a multigrade, composite cemented carbide article, the multigrade, composite cemented carbide article comprising a first cemented carbide portion, corresponding to the first portion of the die, and a second cemented carbide portion of a different grade from the first cemented carbide portion, and corresponding to the second portion of the die.

2. The multigrade cemented carbide article of claim 1 wherein the article is a rolling ring for use in metal rolling, and wherein the first cemented carbide portion is an outer engaging portion of the rolling ring, the first cemented carbide portion being of a grade suitable for use as the outer, engaging portion of the rolling ring, and further wherein the second cemented carbide portion is an inner non-engaging portion of the rolling ring.

3. The multigrade cemented carbide article of claims 1 wherein the article is a combination trimming/slitting knife for use in the sheet metal industry, and wherein the first cemented carbide portion is an outer portion and the first cemented carbide portion is suitable for use in a trimming operation, and further wherein the second cemented carbide portion is an inner portion and the second cemented carbide portion is suitable for use in a slitting operation.

4. A combination trimming/slitting knife for use in the sheet metal industry comprising:

a. an outer portion comprising a first cemented carbide of a first grade, the first grade defined by a first composition and a first microstructure of the first cemented carbide; the outer portion having a first hardness; and b. an inner portion surrounded by the outer portion comprising a second cemented carbide of a second grade, the second grade defined by a second composition and a second microstructure of the second cemented carbide, the second grade being different from the first grade in that a binder content of the second composition is lower than that of a binder content of a first composition, and the second microstructure has a smaller grain size than a grain size of the first microstructure, the outer portion and the inner portion being metallurgically fused via sintering to form a multigrade cemented carbide knife.

5. The combination trimming/slitting knife of claim 4 wherein the first grade is substantially homogeneous throughout the outer portion.

6. The combination trimming/slitting knife of claim 4 wherein the second grade is substantially homogeneous throughout the inner portion.

* * * * *